US007570913B2

(12) United States Patent
Kang et al.

(10) Patent No.: US 7,570,913 B2
(45) Date of Patent: Aug. 4, 2009

(54) HEATING ROLLER ASSEMBLY FOR IMAGE FORMING APPARATUS

(75) Inventors: Dong-kyun Kang, Suwon-si (KR); Dong-jin Seol, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 459 days.

(21) Appl. No.: 11/405,486

(22) Filed: Apr. 18, 2006

(65) Prior Publication Data

US 2007/0104522 A1 May 10, 2007

(30) Foreign Application Priority Data

Nov. 7, 2005 (KR) ..... 10-2005-0105957

(51) Int. Cl.
*G03G 15/20* (2006.01)

(52) U.S. Cl. ..... 399/333; 399/330

(58) Field of Classification Search ..... 399/69, 399/328, 330, 333
See application file for complete search history.

(56) References Cited

U.S. PATENT DOCUMENTS 4,585,325 A * 4/1986 Euler ..... 399/69
6,858,820 B2 * 2/2005 Miura ..... 399/330 X
7,335,863 B2 * 2/2008 Kikuchi et al. ..... 399/330 X
2004/0238531 A1 12/2004 Kikuchi et al.

FOREIGN PATENT DOCUMENTS

JP 2000-29332 1/2000
JP 2003-329030 11/2003
JP 2004-170739 * 6/2004

* cited by examiner

*Primary Examiner*—Sandra L Brase
(74) *Attorney, Agent, or Firm*—Roylance, Abrams, Berdo & Goodman, L.L.P.

(57) ABSTRACT

A heating roller assembly for an image forming apparatus. The heating roller assembly includes a heating roller pipe having a heating layer around which a coil is wound. The heating layer has a coil winding structure such that first portions 'A' formed adjacent to bearings for rotatably supporting the heat roller pipe have a lower thermal temperature than that of second portions 'B' formed adjacent to the first portions A. The first portions A serve as a heat absorber to minimize the fusing heat loss at the beginning of a fusing process, and even if the fusing process continues for a long time, the heat absorber can prevent the opposite ends of the heating roller, where the bearings are disposed, from overheating. Accordingly, a more accurate pickup operation is achieved and a stable quality of image can be guaranteed.

17 Claims, 3 Drawing Sheets

HEATING ROLLER ASSEMBLY FOR IMAGE FORMING APPARATUS

CROSS-REFERENCE TO RELATED APPLICATIONS

This application claims the benefit under 35 U.S.C. § 119 (a) of Korean Patent Application No. 2005-105957, filed Nov. 7, 2005, in the Korean Intellectual Property Office, the entire disclosure of which is hereby incorporated by reference.

BACKGROUND OF THE INVENTION

1. Field of the Invention

The present invention relates to a heating roller assembly disposed in a fusing unit of an image forming apparatus, such as printer, photocopier, multifunction apparatus. More particularly, the present invention relates to a heating roller assembly constituting a fusing unit.

2. Description of the Related Art

In general, a fusing unit of an image forming apparatus comprises a heating roller to heat a sheet of printing paper at a fusing temperature and a pressure roller rotated in contact with the heating roller to apply a pressure to the printing paper.

The heating roller is divided into a resistance heating roller and an inductive heating roller according to a heating method. The inductive heating roller is coming into increasing use in recent years in view of a high reliability and fusing efficiency.

The inductive heating roller has a metallic heating roller pipe wound by a copper coil. The inductive heating roller indirectly heats the heating roller pipe using an electromagnetic force generated by electrifying the coil. For example, if an alternating current (AC) of several tens or hundreds of Hz is applied to the coil from a power circuit, an AC magnetic flux is generated in the heating roller pipe wound by the coil such that an inductive current is generated in a circumferential direction of the heating roller pipe. The inductive current generates a Joule's heat and thus low frequency inductive heat raises the temperature of the heating roller pipe to a temperature (150~200° C.) suitable for the fusing process.

Since a portion of the heating roller pipe where the coil is closely wound has a higher AC magnetic flux than a portion where the coil is sparsely wound, the portion where the coil is closely wound emits a large amount of heat. The thermal temperature of the emitted heat is controlled by adjusting the number of turns of the coil. The inductive heating method is disclosed in U.S. Pat. No. 6,341,211 and JP Patent Laid-open application 2000-029332.

However, if the heating roller pipe remains at a high temperature for a long time, a bearing supporting the heating roller pipe is subjected to the heat of the heating roller pipe and overheats. Therefore, the bearing may be damaged. Also, if an excessive heat is transmitted to the bearing, a bearing supporting member, which is made of a resin material, may melt. If the heat from the overheated bearing is transmitted back to the heating roller pipe, a difference between the temperature of a center potion of the heating roller pipe and the opposite ends can occur, which causes a hot offset.

SUMMARY OF THE INVENTION

An aspect of the present invention is to address at least the above problems and/or disadvantages and to provide at least the advantages described below. Accordingly, an aspect of the present invention is to provide a heating roller assembly for an image forming apparatus which has an improved heating layer to maintain a constant temperature over a heating roller pipe and prevent a print error caused by overheating of a bearing supporting the heating roller pipe.

The above aspect is achieved by providing a heating roller assembly for an image forming apparatus, including a cylindrical heating roller pipe and a heating layer formed on an inner circumference of the heating roller pipe. The heating layer includes heat-absorbing portions formed at opposite ends thereof and primary heating portions disposed adjacent to the heat-absorbing portions and emitting high temperature heat.

Preferably, but not necessarily, the heating layer is fabricated by winding a coil around the heating roller pipe.

The above aspect is also achieved by providing a heating roller assembly for an image forming apparatus, including a heating roller pipe having a heating layer around which a coil is wound, a first end cap disposed at one end of the heating roller pipe and having an electrode connected to the coil, a second end cap disposed at the other end of the heating roller pipe and having a driving force transmitter, and bearings disposed at the opposite ends of the heating roller pipe to rotatably support the heating roller pipe, wherein the heating layer has a coil winding structure such that first portions 'A' formed adjacent to the bearings have a lower thermal temperature than that of second portions 'B' formed adjacent to the first portions A.

Preferably, but not necessarily, a coil pitch of the coil wound around the first portions 'A' is longer than that of the coil wound around the second portions 'B'.

Preferably, but not necessarily, the coil pitch of the coil wound around the second portions 'B' is at least 1 mm.

The above aspects are also achieved by providing a method of heating a roller assembly of an image forming apparatus, wherein the heating roller assembly includes a cylindrical heating roller having first and second ends and a heating layer formed on an inner surface of the roller. The method comprises heating first portions of the roller at the first and second ends to a first temperature. Second portions of the roller are heated adjacent the first portions at a second temperature, where the second temperature is higher than the first temperature.

These and other aspects of the invention will become apparent from the following detailed description of the invention which taken in conjunction with the annexed drawings disclose various embodiments of the invention.

BRIEF DESCRIPTION OF THE DRAWINGS

The above and other objects, features, and advantages of certain exemplary embodiments of the present invention will be more apparent from the following description taken in conjunction with the accompanying drawings, in which.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
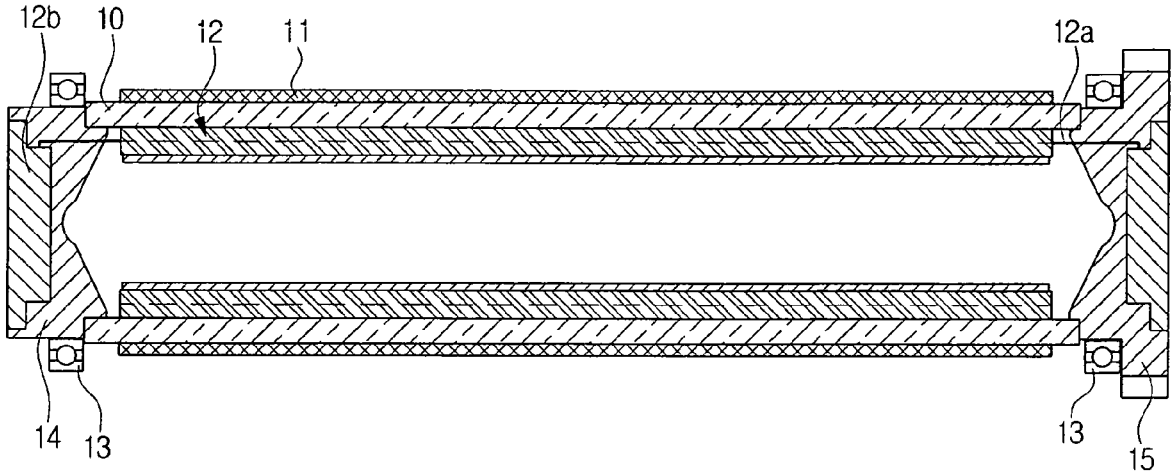
FIG. 1 is a cross-sectional side view illustrating a heating roller assembly for an image forming apparatus according to an embodiment of the present invention.

FIG. 1 is a cross-sectional view illustrating an inductive heating roller assembly according to an embodiment of the present invention.

Referring to FIG. 1, a heating roller pipe 10 has a Teflon™ coating layer 11 formed on a surface thereof and a heating layer 12 around which a coil 12*a* is wound. Bearings 13 are disposed at opposite ends of the heating roller pipe 10 to rotatably support the heating roller pipe 10.

A first end cap 14 is disposed at one end of the heating roller pipe 10 and comprises an electrode 12*b* connected to the coil 12*a*. A second end cap 15 is disposed at the opposite end to the first end cap 14 and comprises a driving force transmitter.

Figure 2:
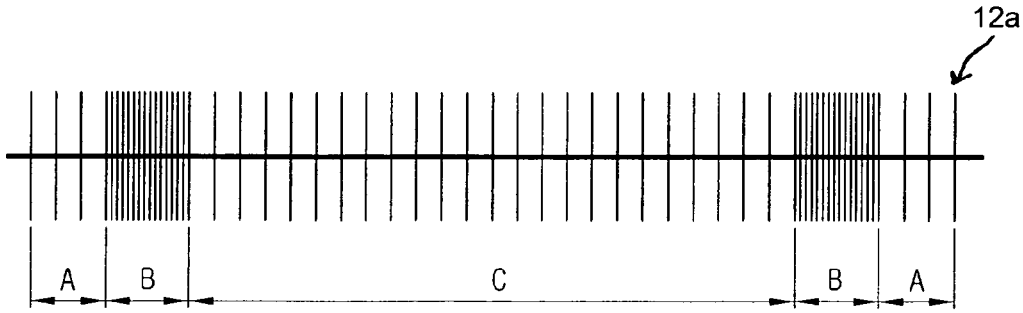
FIG. 2 is a view illustrating a coil winding structure of a heating layer of the heating roller assembly for the image forming apparatus according to an embodiment of the present invention.

The coil winding structure of the heating layer 12 is illustrated in FIG. 2.

A coil pitch of the coil 12*a* wound around first portions A (heat-absorbing portions) adjacent to the opposite ends of the heating roller pipe 10 and a coil pitch of the coil 12 wound around second portion B (primary heating portions) adjacent to the first portions A satisfy the following condition:

[Condition]

wherein the coil pitch of the coil wound around the first portion A>the coil pitch of the coil wound around the second portion B Since the coil 12*a* is more sparsely wound around the first portions A compared to that around the second portions B, the first portions A have a lower temperature than that of the second portions B. As depicted in FIG. 2, the coil windings in the first portions A are spaced apart a greater distance than the coil windings in the second portions B. Accordingly, the first portions A serve as a heat absorber and thereby prevent heat generated in the second portions B (primary heating portions) from being directly transmitted to the bearings 13.

The coil pitch of the coil 10*a* wound around the first portions A (heat-absorbing portions) is the same as or longer than that of the coil 10*a* wound around a third portion C (general heating portion) at the center of the heating roller pipe 10. The coil pitch of the coil 12*a* wound around the first and the third portions A and C ranges from 3 mm to 6 mm.

A distance between coils wound around the second portions B of the heating roller pipe 10 is at least 1 mm but less than the distance between coils of the first portions A. If the coil pitch of the coil 10*a* wound around the second portions B is less than 1 mm, a malfunction may be caused by short circuit. In the illustrated embodiment, the portions A, B and C are formed from a continuous coil. In other embodiments, each portion is heated and the temperature is controlled by separate heating devices.

According to the coil winding structure as described above, a uniform temperature distribution of the heating roller pipe 10 can be obtained.

Figure 3:
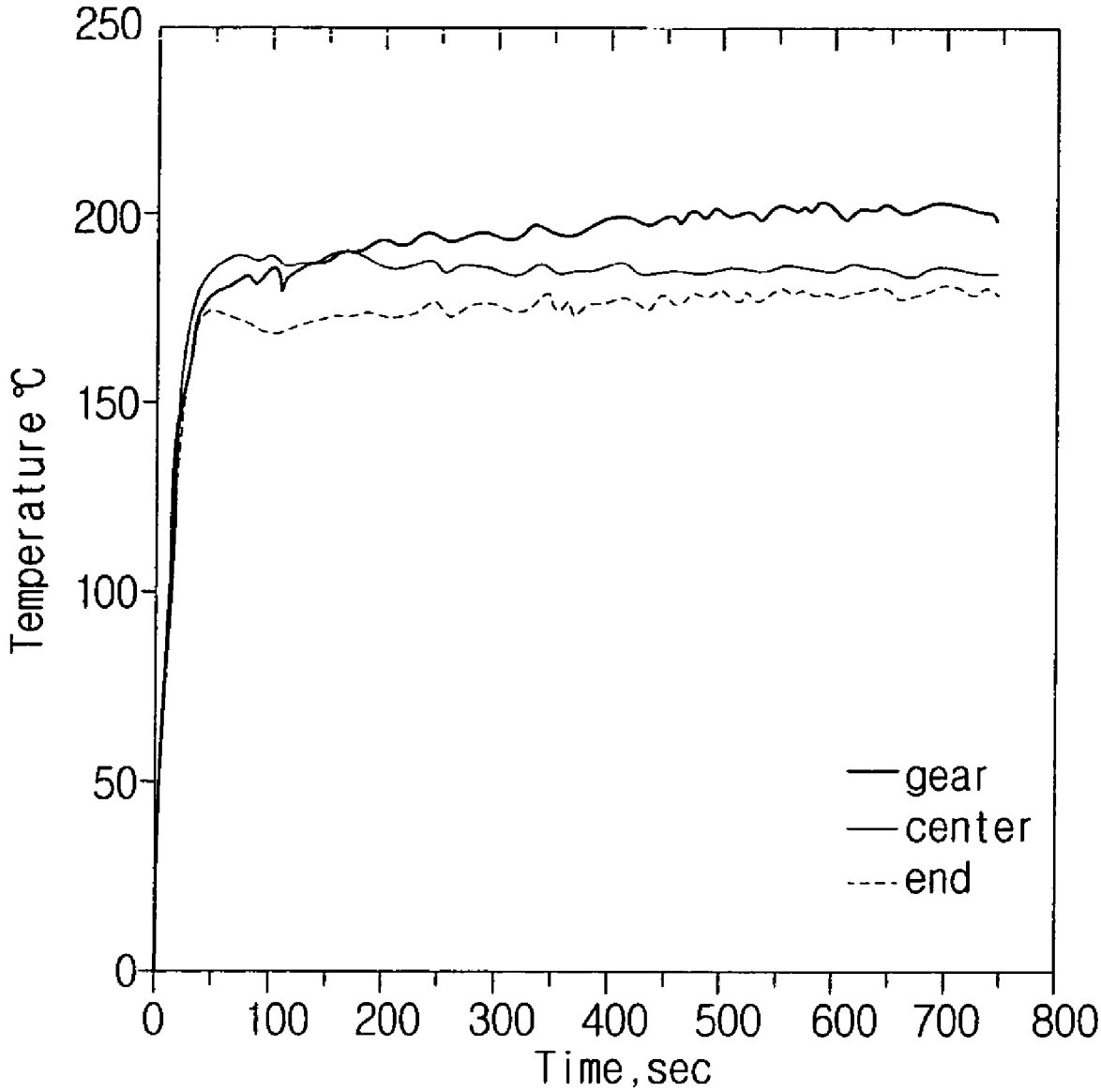
FIG. 3 (PRIOR ART)
FIG. 3 is a graph illustrating a temperature distribution of a heating roller assembly for a general image forming apparatus of the prior art.

FIG. 3 is a graph illustrating a temperature distribution of a general heating roller pipe of a prior device. Referring to FIG. 3, a temperature difference of approximately 20° C. to 30° C. occurs between the opposite ends of the heating roller pipe 10 and the center of the heating roller pipe 10. Due to the temperature difference a hot offset is caused.

According to the present invention, since the heat absorber (the first portions A of FIG. 2) is provided in the heating layer 12, the heat generated at the primary heating portions (second portions B of FIG. 2) are distributed to the heat absorber and thus the heat is uniformly distributed in the heating roller pipe 10. Since there is a small difference between the temperature of the center of the heating roller pipe 10 and the opposite ends of the heating roller pipe 10, a print error such as hot offset can be prevented.

Figure 4:
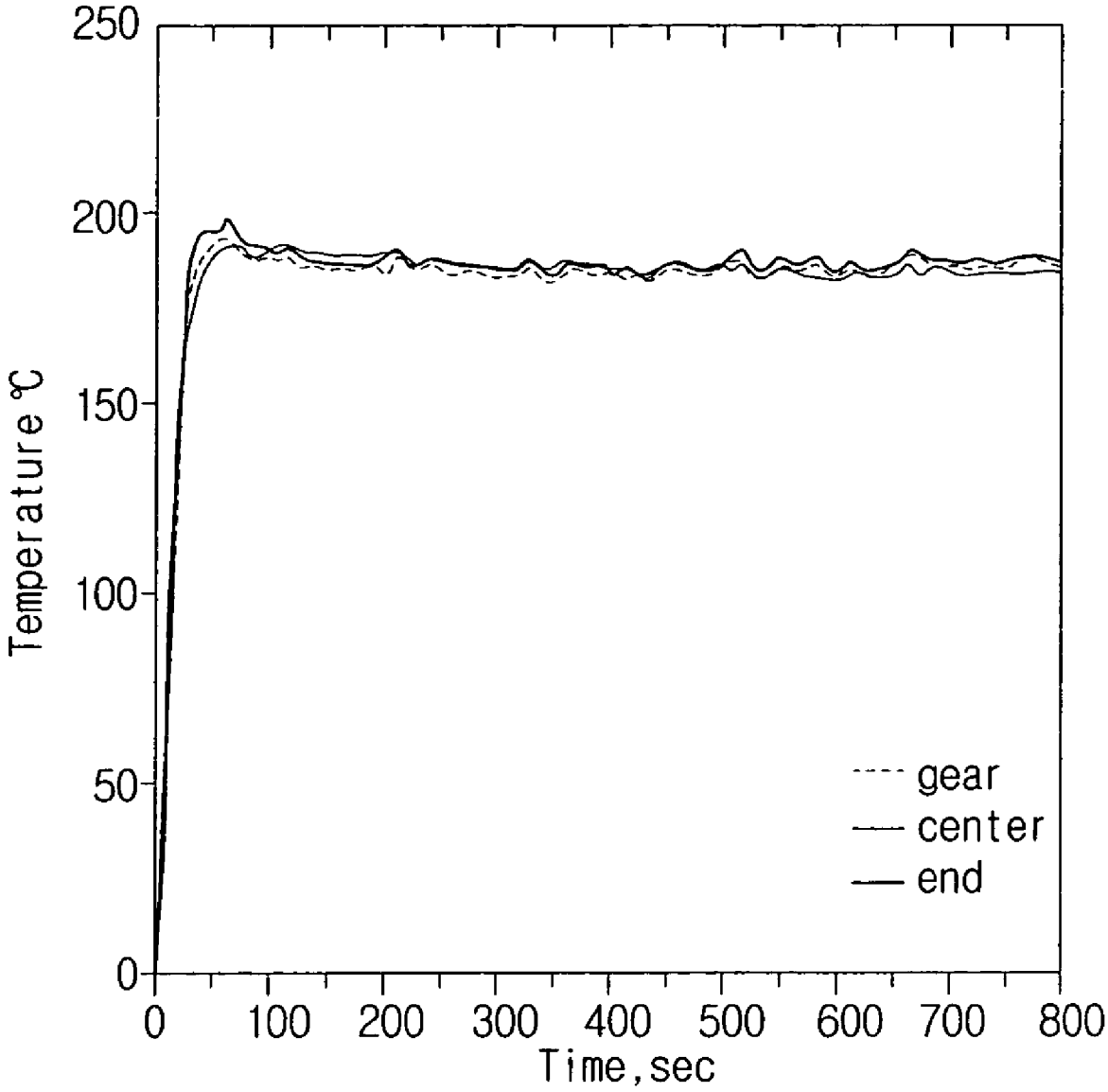
FIG. 4 is a graph illustrating a temperature distribution of the heating roller assembly for the image forming apparatus according to an embodiment of the present invention.

According to the present invention as described above, since the heat absorber is provided in the heating layer 12 of the heating roller pipe 10, a fusing heat loss is minimized at the beginning of a fusing process, and even if the fusing process continues for a long time, the heat absorber can prevent the opposite ends of the heating roller from overheating where the bearings 13 are disposed. As shown in the graph of FIG. 4, the temperature distribution is much more uniform compared to the prior device.

Since the heat absorber prevents a thermal stress from being generated at a specific portion, the surface of the heating roller has a constant temperature.

In one embodiment, the heating roller 10 and heating layer 12 have secondary heating members or heating sections at the ends of the roller to define the heating portions A. The roller also includes primary heating members spaced inwardly from the heating portions A to define primary heating portions B. The primary heating members and the primary heating portions are at a temperature higher than the portions B so that portions B absorb heat from the primary heating members without overheating the bearings and providing substantially uniform heat distribution. A third heating member is provided between the two primary heating members of portion C. The heating members of portion C typically heat the middle portion C at the same temperature as portion A, which is a lower temperature than primary portions B.

While the invention has been shown and described with reference to certain exemplary embodiments thereof, it will be understood by those skilled in the art that various changes in the form and details may be made therein without departing from the spirit and scope of the invention as defined by the appended claims.

What is claimed is:

1. A heating roller assembly for an image forming apparatus, comprising:

a cylindrical heating roller pipe; and a heating layer formed on an inner circumference of the heating roller pipe, wherein the heating layer comprises heat-absorbing portions, whose coil pitch is Pa, formed at opposite ends thereof and primary heating portions, having a pair of primary heating members spaced apart from each other and being spaced inwardly from opposite ends of the roller pipe with a coil pitch Pp, disposed adjacent to the heat-absorbing portions, wherein Pa>Pp.

2. The heating roller assembly as claimed in claim 1, wherein the heating layer is fabricated by winding a coil around the heating roller pipe.

3. The heating roller assembly of claim 1, wherein said heat-absorbing portions comprise secondary heating members, said second heating members heating said roller pipe at a temperature less than a temperature of said primary heating members.

4. The heating roller assembly of claim 3, further comprising a third heating member positioned between first heating members.

5. The heating roller assembly of claim 4, wherein said third heating member heats said roller pipe at a temperature less than said primary heating members to define a heat-absorbing portion between the primary heating portions.

6. The heating roller assembly of claim 5, wherein said primary, secondary and third heating members are formed from a continuous heating coil.

7. A heating roller assembly for an image forming apparatus, comprising:

a heating roller pipe having a heating layer around which a coil is wound;

a first end cap disposed at a first end of the heating roller pipe and having an electrode connected to the coil;

a second end cap disposed at an opposite second end of the heating roller pipe and having a driving force transmitter; and bearings disposed at the first and second ends of the heating roller pipe to rotatably support the heating roller pipe, wherein the heating layer has a coil winding structure with first coil portions 'A' formed adjacent to the bearings and having a lower thermal temperature than that of second coil portions 'B' formed adjacent to the first coil portions A.

8. The heating roller assembly as claimed in claim 7, wherein a coil pitch of the first coil wound around the first portions 'A' is longer than a coil pitch of the second coil wound around the second portions 'B'.

9. The heating roller assembly as claimed in claim 7, wherein the coil pitch of the second coil wound around the second portions 'B' is at least 1 mm.

10. A method of heating a roller assembly of an image forming apparatus, said heating roller assembly including a cylindrical heating roller having first and second ends and a heating layer formed on an inner surface of said roller, said method comprising:

heating first portions of said roller at said first and second ends at a first temperature, and heating second portions of said roller adjacent each of said first portions at a second temperature, where said second temperature is higher than said first temperature, and where said first portions absorb heat from said second portions to prevent overheating of said bearings and said second portions are spaced apart, and where said method further comprises heating a third portion of said roller between said second portions.

11. The method of claim 10, wherein said third portion is heated to said first temperature.

12. An image forming apparatus, comprising:

a paper cassette containing paper;

a paper feeding unit picking up the paper from the paper cassette;

a developer printing an image on the picked-up paper; and a fuser comprising a heating roller assembly heating the image-printed paper and a pressing roller assembly pressing the image-printed paper, wherein the heating roller assembly comprises, a cylindrical heating roller pipe, and a heating layer formed on an inner circumference of the heating roller pipe, wherein the heating layer comprises heat-absorbing portions, whose coil pitch is Pa, formed at opposite ends thereof and primary heating portions, having a pair of primary heating members spaced apart from each other and having a coil pitch Pp, disposed adjacent to the heat-absorbing portions, wherein Pa>Pp, and where the primary heating members are spaced inwardly from opposite ends of the roller pipe.

13. The image forming apparatus as claimed in claim 12, wherein the heating layer is fabricated by winding a coil around the heating roller pipe.

14. The image forming apparatus of claim 12, wherein said heat-absorbing portions comprise secondary heating members, said second heating members heating said roller pipe at a temperature less than a temperature of said primary heating members.

15. The image forming apparatus of claim 14, further comprising a third heating member positioned between first heating members.

16. The image forming apparatus of claim 15, wherein said third heating member heats said roller pipe at a temperature less than said primary heating members to define a heat-absorbing portion between the primary heating portions.

17. The image forming apparatus of claim 16, wherein said primary, secondary and third heating members are formed from a continuous heating coil.

* * * * *

UNITED STATES PATENT AND TRADEMARK OFFICE

CERTIFICATE OF CORRECTION

PATENT NO. : 7,570,913 B2
APPLICATION NO. : 11/405486
DATED : August 4, 2009
INVENTOR(S) : Kang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 567 days.

Signed and Sealed this

Seventh Day of September, 2010

David J. Kappos

David J. Kappos
*Director of the United States Patent and Trademark Office*